US006345158B1

(12) United States Patent
Oono

(10) Patent No.: US 6,345,158 B1
(45) Date of Patent: Feb. 5, 2002

(54) METHOD AND AN IMAGE FORMING APPARATUS WITH A MAGNETIC RECORDING LAYER

(75) Inventor: Michiteru Oono, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/589,082

(22) Filed: Jun. 8, 2000

(51) Int. Cl.[7] ..... G03G 15/00
(52) U.S. Cl. ..... 399/10; 399/26
(58) Field of Search ..... 399/10, 25, 26, 399/162

(56) References Cited

U.S. PATENT DOCUMENTS 5,278,612 A * 1/1994 Inui ..... 399/26
5,313,254 A * 5/1994 Temple ..... 399/78
5,659,855 A * 8/1997 Stelter et al. ..... 399/162 X
5,732,312 A * 3/1998 Takekoshi et al. ..... 399/162 X
5,802,419 A * 9/1998 Sakurai et al. ..... 399/26
5,835,818 A * 11/1998 Hoshika et al. ..... 399/26
5,963,757 A * 10/1999 Factor ..... 399/40

FOREIGN PATENT DOCUMENTS

| | | | |
|---|---|---|---|
| JP | 5-181334 | * | 7/1993 |
| JP | 8-194408 | * | 7/1996 |
| JP | 8-220949 | * | 8/1996 |
| JP | 9-190121 | | 7/1997 |
| JP | 10-039693 | * | 2/1998 |

* cited by examiner

*Primary Examiner*—Fred L Braun
(74) *Attorney, Agent, or Firm*—Foley & Lardner

(57) ABSTRACT

An image forming apparatus includes an image carrier that includes a tube, a photosensitive layer provided at a part of the tube for forming an image forming area, and a magnetic recording layer provided at a part of the tube that is outside of the image forming area. The image forming apparatus also includes a writing/reading device that writes a using history of the image carrier on the magnetic recording layer. An information processing method includes recording a measured time information of a photosensitive drum on a magnetic recording layer on the photosensitive drum.

16 Claims, 4 Drawing Sheets

METHOD AND AN IMAGE FORMING APPARATUS WITH A MAGNETIC RECORDING LAYER

BACKGROUND OF THE INVENTION

1. Field of the Invention

The present invention relates to e image forming apparatus that can be easily initialized when an image carrier or a process cartridge is exchanged.

2. Description of the Related Art

In an image forming apparatus, when an image carrier or a process cartridge was exchanged, the initialization is required and much labor is needed to input data for the initialization. In the Japanese Laid Open Patent No. 9-190121, an image forming apparatus that stores such data as amount of use, characteristics of a process cartridge in a non-volatile storage means provided in a process cartridge and makes the reading/writing through the main body of the image forming apparatus is disclosed.

However, the above-mentioned image forming apparatus has such problems that cost increase results from the use of a non-volatile storage means and increase in the number of replacing parts in the recycle of used cartridge of which life war exhausted is caused.

SUMMARY OF THE INVENTION

An object of the present invention is to provide an image forming apparatus that requires no initialization when exchanging an image carrier or a process cartridge and does not cause cost increase.

According to the present invention, there is provided an image forming apparatus comprising an image carrier for forming an electrostatic latent image; and developing means for forming a developer image on the image carrier by supplying a developer to the electrostatic latent image; the image carrier including a tube; a photosensitive layer that is provided at a part of the tube and forms an image forming area; and a magnetic recording layer provided at the outside of the image forming area.

DETAILED DESCRIPTION OF THE PREFERRED EMBODIMENT

Figure 1:
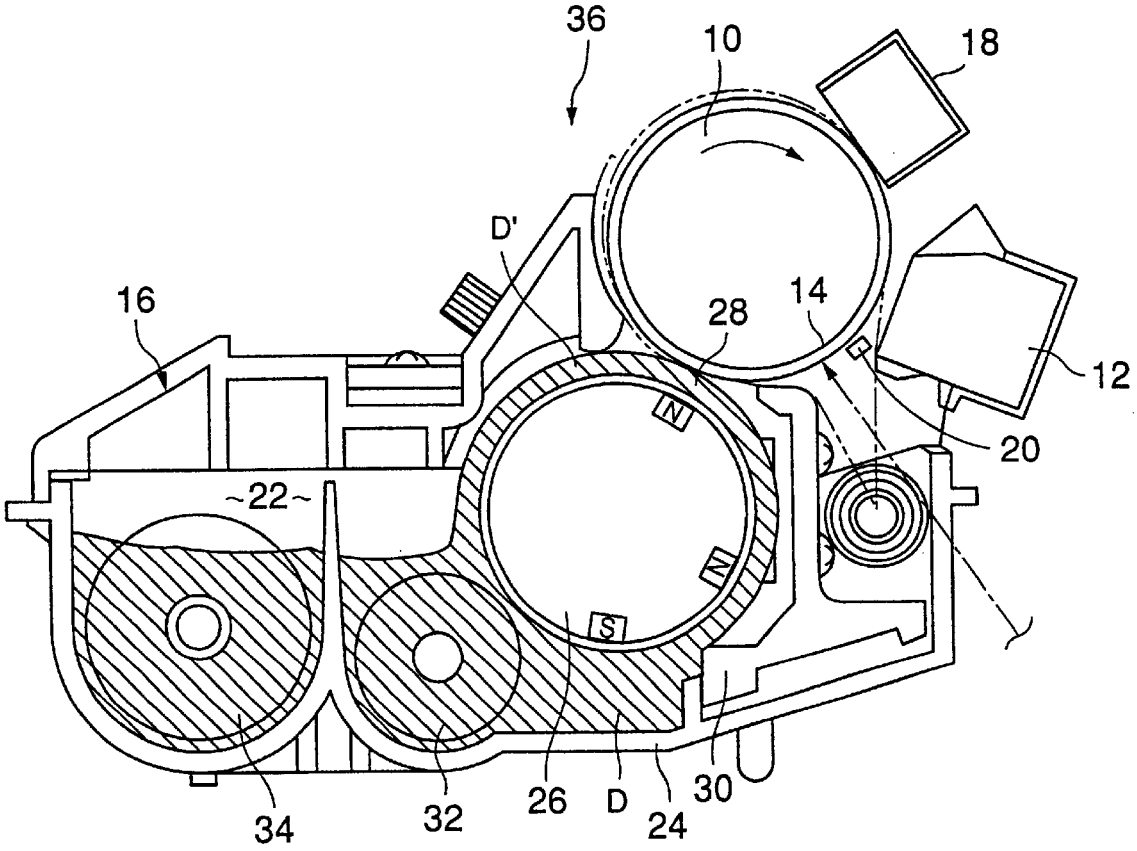
FIG. 1 is a side view showing a process cartridge including a photosensitive drum in an image forming apparatus of the present invention.

A preferred first embodiment of the present invention will be described below referring to the drawings.

FIG. 1 shows a process cartridge including a photosensitive drum of an image forming apparatus. Around a photosensitive drum 10 that is an image carrier, there are arranged a main charger 12, an exposing portion 14, a developing unit 16, a transferring charger (not shown) and a charge eliminator 18 in order. Between the main charger 12 and the exposing portion 14, a magnetic head 20 is arranged. Further, the charge eliminator 18 is mounted to the main body of the image forming apparatus and not included in the process cartridge.

The developing unit 16 is provide with the photosensitive drum 10 and a developing roller 26 facing the photosensitive drum 10 in a casing 24 that has a developer storage portion 22. This developer storage portion 22 houses two-component developing agent D' comprising toner and carrier particles. At the sliding portion of a developer magnet brush D' contacting the photosensitive drum 10 formed on the surface of the developing roller 26, that is, at the upper stream side from a developing position 28 in the rotary direction of the photosensitive drum 10, a doctor 30 is provided for defining a thickness of the developer magnetic brush D'.

Further, a first and a second developer stirrers 32 and 34 are housed in the developer storage portion 22.

In the developing unit 16, the photosensitive drum 10 and the main charger 12 are assembled in one united body and comprises a process cartridge 36. This process cartridge 36 is so arranged that it can be put into/taken out of the main body of the image forming apparatus.

Figure 2:
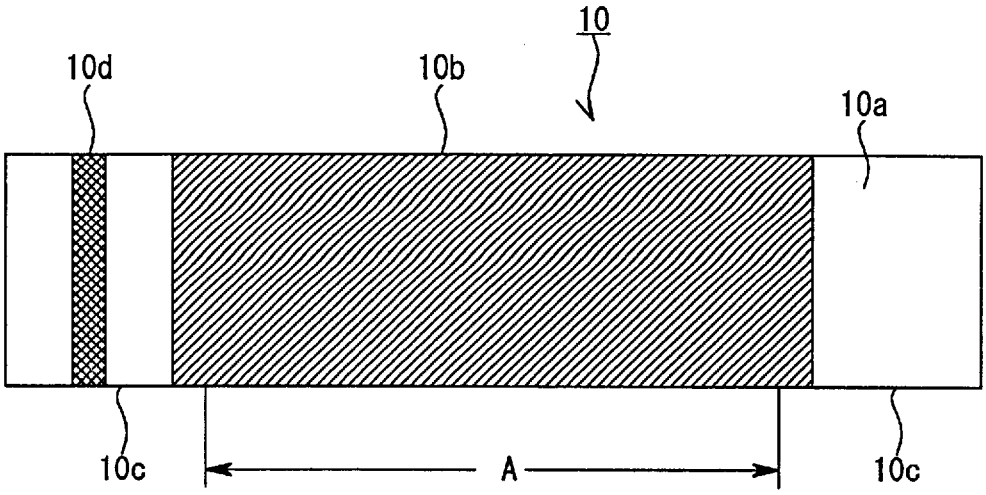
FIG. 2 is a front view showing the photosensitive drum having an information recording portion shown in FIG. 1.

The photosensitive drum 10 has a photosensitive layer 10*b* nearly at the central portion of the tube 10*a* as shown in FIG. 2, and the inside away by some distance from both sides of the photosensitive layer 10*b* is an image forming area A. On a portion 10*c* of the tube 10*a,* where the photosensitive layer 10*b* is not formed, a band shaped magnetic recording layer 10*d* mixed with magnetic powder for magnetic recording is coated. This magnetic recording layer 10*d* is formed in a width larger than that of the magnetic head 20 and in a thickness 10–100 $\mu$m that is able to maintain wear resistance uniformly in the circumferential direction of the photosensitive drum 10. Further, the magnetic recording layer 10*d* may be formed on the photosensitive layer 10*b* if it is the outside of the image forming area A provided that the peeling characteristic is not adversely affected.

When the photosensitive drum 10 is not yet used, initial information of the photosensitive drum 10 is magnetically recorded on the magnetic recording layer 10*d.* This initial information includes high-tension output voltage that is supplied to, for instance, the main charger 12 of the main body of the image forming apparatus and a correction value of an image processing parameter according to the initial characteristic of the photosensitive drum 10, a counter value ("0" because not yet used) representing using history data of the photosensitive drum 10, etc. The correction value of the image processing parameters is, for instance, the optimum value that decides the relation between the density of an original to be copied and that of an output image, etc.

It is desirable that the magnetic head 20 arranged between the main charger 12 and the exposing portion 14 is brought into contact with the magnetic recording layer 10*d.* However, if an SN ration is secured, without bringing the magnetic head 20 into contact with the magnetic recording layer 10*d,* a gap may be provided between them.

Figure 3:
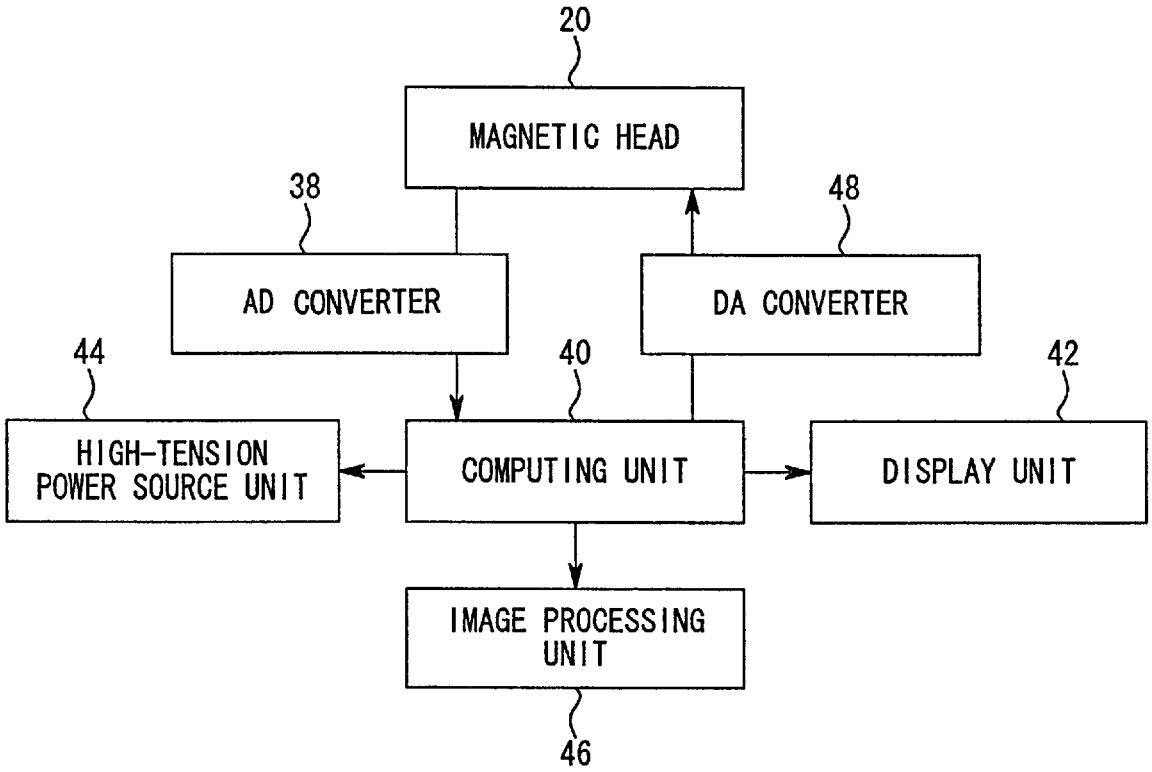
FIG. 3 is a block diagram of the image forming apparatus of the present invention, including an information reading/writing means (a magnetic head) for the information recording portion shown in FIG. 2.

FIG. 3 shows a block diagram of the image forming apparatus of the present invention including an information reading/writing means from/to the information recording portion shown in FIG. 2. The initial information read by the magnetic head 20 from the magnetic recording layer 10*d* on the photosensitive drum 10 is binarized by an AD converter 38 and the binarized information is input to a computing unit 40. In this computing unit 40, the high-tension output voltage and the image processing parameter are changed based on the input binary information. Out of the changed results, the high-tension output value is input into a high-tension power source unit 44 and the image processing parameter value is input into an image processing unit 46 and predetermined information is displayed on a display unit 42, accordingly.

On the other hand, regarding the information change such as updating of the using history data of the photosensitive drum 10, the results obtained in the computing unit 40 are converted by a DA converter 48 and the data of the converted results are input to the magnetic recording head 20. The magnetic recording layer 20 records the data of the converted results magnetically on the magnetic recording layer 10*d* on the photosensitive drum 10.

Figure 4:
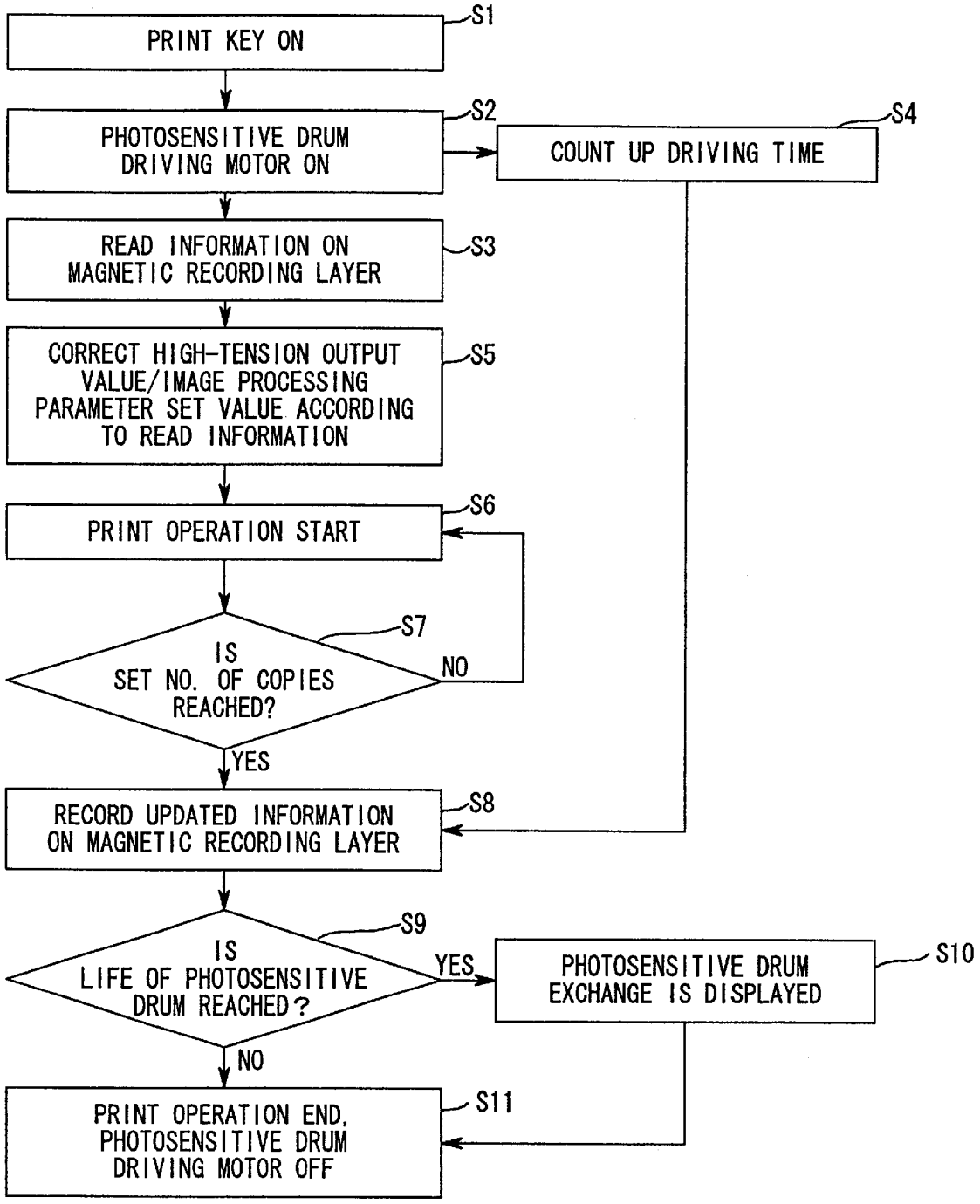
FIG. 4 is a flowchart showing the actions by the information reading/writing means shown in FIG. 3.

Next, referring to a flowchart shown in FIG. 4, the data read/write from/to the magnetic recording layer 10*d* on the photosensitive drum 10 will be explained.

When a print key (not shown) is depressed (S1), the driving motor to rotate the photosensitive drum 10 begins to operate (S2). With the rotation of the photosensitive drum 10, the magnetic recording head 20 reads the information recorded on the magnetic recording layer 10*d* on the photosensitive drum 10 (S3) and counts the operating time of the driving motor (S4). According to the magnetic recording information read in Step S3, high-tension output value and the image processing parameter set value are corrected (S5). Correction values of such printing conditions as high-tension output value and image processing parameter, etc. are decided and based on this printing condition, the printing (copying) of the number of sheets set by user is executed (S6 and S7).

When the printing operation is completed, the motor driving time is read and added, and a counter value is updated to represent the using history data of the photosensitive drum 10, and this updated counter value is recorded magnetically on the magnetic recording layer 10*d* on the photosensitive drum 10 by the magnetic recording head 20 (S8). The added value of the motor driving time, that is, the rotating distance of the photosensitive drum 10 is a parameter to know the using deterioration of the photosensitive drum 10, and when the counter value reaches a predetermined value, it is judged whether the photosensitive drum 10 reaches its life (S9). When judged in Step S9 that the photosensitive drum 10 reaches the life, it is so displayed on the display unit 42 and user is advised to exchange the photosensitive drum 10 or the process cartridge including the photosensitive drum 10 (S10). Further, at this time, no information is written onto the magnetic recording layer 10*d*.

When it is judged that the photosensitive drum 10 has not yet reached the life in Step S9, the printing operation is terminated and the motor is stopped to drive the photosensitive drum 10(S11).

Figure 5:
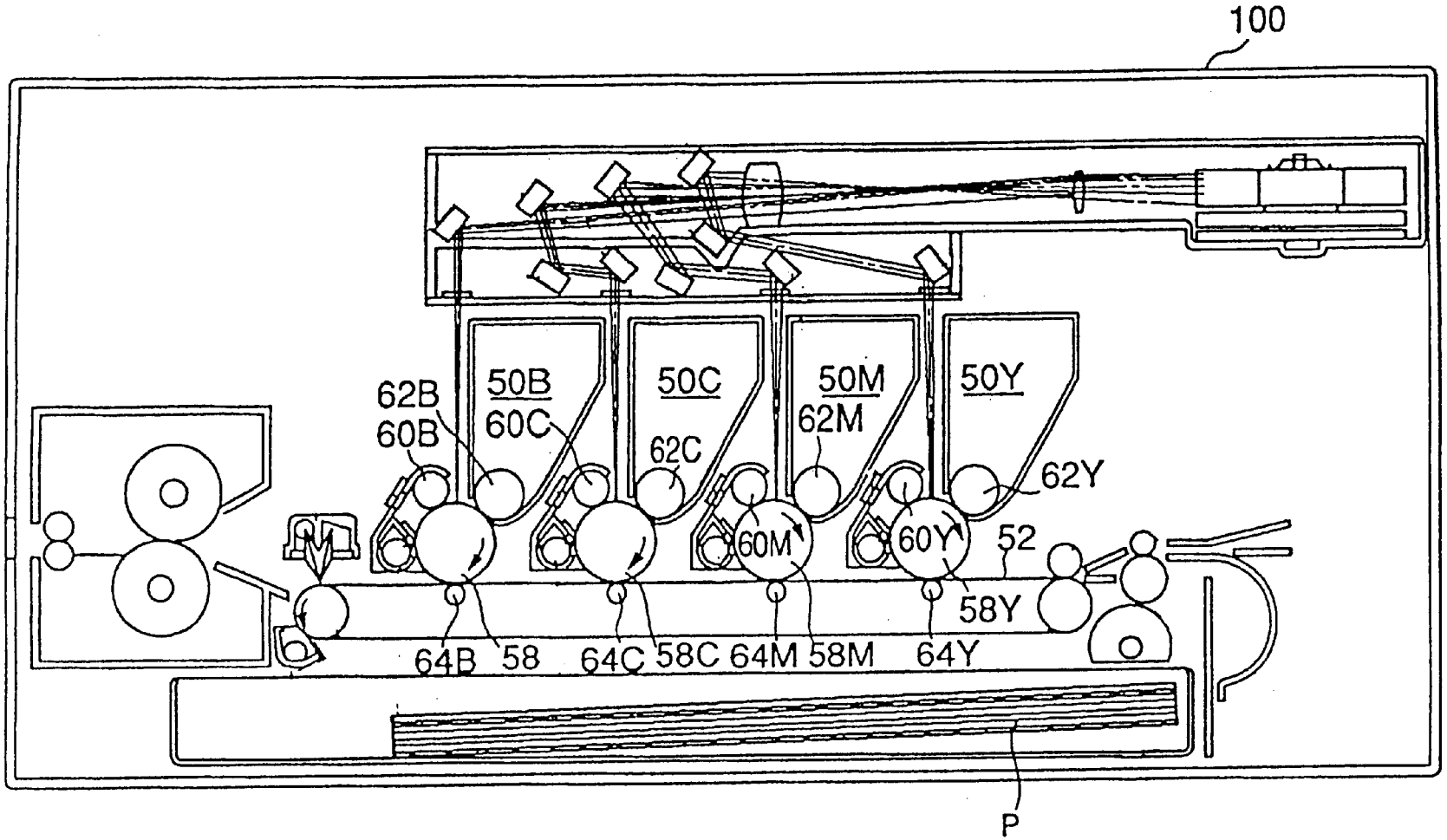
FIG. 5 is a schematic front view showing an image forming apparatus in a second embodiment of the present invention.

FIG. 5 shows a second embodiment of the present invention.

In an image forming apparatus 100 shown in FIG. 5, plural photosensitive drums 58Y, 58M, 58C and 58B are arranged along the conveying direction of a paper P on which images formed on respective drums are transferred.

Main chargers 60Y, 60M, 60C and 60B, developing units 62Y, 62M, 62C and 62B, etc. comprise plural image forming units 50Y, 50M, 50C and 50B. By these plural image forming units 50Y, 50M, 50C and 50B, yellow, magenta, cyan and black color toner images are formed. The yellow, magenta, cyan and black color toner images are multi-transferred on a paper P conveyed on the transfer belt 52 by transferring rollers 64Y, 64M, 64C and 64B that are applied with bias voltage.

Kinds of developers or toners that are used by this image forming apparatus differ for each color and the life of the photosensitive drums may be influenced by these developers or toners. Therefore, in the case of the image forming apparatus in this second embodiment, the magnetic recording layer 10*d* as shown in FIG. 2 is provided to each of the photosensitive drums 58Y, 58M, 58C and 58B, and information of developers or toner colors that are used corresponding to the photosensitive drums and information of initial characteristics of the photosensitive drums as in the first embodiment are magnetically recorded on this magnetic recording layer 10*d*. Thus, by magnetically recording the information peculiar to each photosensitive drum, the life of the photosensitive drum can be managed for each color.

As described above in detail, according to the present invention, the photosensitive drums serving as image carriers or the photosensitive drums themselves of the process cartridge including the photosensitive drums have an information recording portion and information is recorded thereon. Therefore, the troublesome initialization at the time when the photosensitive drum or the process cartridge is exchanged will become unnecessary. Furthermore, since it is not required to add such a non-volatile memory as an expensive memory chip, etc. to a process cartridge, the cost increase will not result. Further, when recycling a used process cartridge of which life was expired, information can be reset only by exchanging the photosensitive drum and replacement parts can be restricted to the minimum.

Further, in the case of a color image forming apparatus that has plural photosensitive drums, the life of the photosensitive drums can be managed by each color.

What is claimed is:

1. An image forming apparatus comprising:

an image carrier for forming an electrostatic latent image; and developing means for forming a developer image on the image carrier by supplying a developer to the electrostatic latent image;

the image carrier including:

a tube;

a photosensitive layer that is provided at a part of the tube and forms an image forming area; and a magnetic recording layer provided at a part of the tube that is outside of the image forming area.

2. An image forming apparatus according to claim 1, further comprising:

writing/reading means arranged facing the magnetic recording layer for magnetically writing/reading information to/from the magnetic recording layer.

3. An image forming apparatus according to claim 1, wherein the magnetic recording layer is formed on the tube at a portion where the photosensitive layer is not provided.

4. An image forming apparatus according to claim 2, wherein the information written on the magnetic recording layer is a value of high-tension output voltage to be supplied to a charging means for charging the image carrier before forming the electrostatic latent image on the image carrier and this value is read by the writing/reading means.

5. An image forming apparatus according to claim 2, wherein the information written on the magnetic recording layer is an image processing parameter required for forming the developer image on the image carrier and this parameter is read by the writing/reading means.

6. An image forming apparatus according to claim 2, wherein the writing/reading means writes a using history of the image carrier on the magnetic recording layer.

7. An image forming apparatus according to claim 6, further comprising:

judging means for judging the life of the image carrier based on the using history of the image carrier.

8. An image forming apparatus according to claim 1, wherein the image carrier and the developing means are incorporated in one united body and comprise an exchangeable cartridge.

9. An image forming apparatus according to claim 7, further comprising:

display means for displaying a need for the image carrier or a cartridge to be exchanged when the judging means judges that the life of the image carrier is expired.

10. An image forming apparatus comprising:

plural image carriers for forming electrostatic latent images; and developing means for forming color developer images on respective image carriers by supplying developers to the electrostatic latent images;

each image carrier including:

a tube;

a photosensitive layer that is provided at a part of the tube and forms an image forming area; and a magnetic recording layer provided at a part of the tube that is outside of the image forming area.

11. An image forming apparatus according to claim 10, wherein the information written on the magnetic recording layers is color information to which the image carriers are corresponding.

12. An information processing method in an image forming apparatus that has a photosensitive drum, comprising the steps of:

driving the photosensitive drum to rotate;

reading information recorded on a magnetic recording layer formed at an outside of an image forming area of the photosensitive drum;

correcting a set value of an image processing parameter according to the information read in the reading step;

forming an image on the photosensitive drum according to the corrected set value;

measuring a driving time to rotate the photosensitive drum;

recording the measured driving time information on the magnetic recording layer as an updated information; and reading the updated information and judging the life of the photosensitive drum according to the updated information.

13. The information processing method according to claim 12, further comprising a step of:

displaying the judgement made in the judging step that the photosensitive drum reached the life and urging user to exchange the photosensitive drum.

14. An image forming apparatus comprising:

an image carrier for forming an electrostatic latent image; and developing means for forming a developer image on the image carrier by supplying a developer to the electrostatic latent image;

the image carrier including:

a tube;

a photosensitive layer that is provided at a part of the tube and forms an image forming area;

a magnetic recording layer provided at a part of the tube that is outside of the image forming area; and writing/reading means arranged facing the magnetic recording layer for magnetically writing/reading information to/from the magnetic recording layer;

wherein the writing/reading means writes a using history of the image carrier on the magnetic recording layer.

15. An image forming apparatus comprising:

plural image carriers for forming electrostatic latent images; and developing means for forming color developer images on respective image carriers by supplying developers to the electrostatic latent images;

each image carrier including:

a tube;

a photosensitive layer that is provided at a part of the tube and forms an image forming area;

a magnetic recording layer provided at a part of the tube that is outside of the image forming area; and writing/reading means arranged facing the magnetic recording layer for magnetically writing/reading information to/from the magnetic recording layer;

wherein the writing/reading means writes a using history of the image carrier on the magnetic recording layer.

16. An image forming apparatus comprising:

an exchangeable cartridge including an image carrier to form an electrostatic latent image and a developing device to form a developer image on the image carrier by supplying a developer to the electrostatic latent image;

the image carrier in the cartridge including:

a tube;

a photosensitive layer that is provided at a part of the tube and forms an image forming area;

a magnetic recording layer provided at a part of the tube that is outside of the image forming area; and writing/reading means arranged facing the magnetic recording layer for magnetically writing/reading information to/from the magnetic recording layer;

wherein the writing/reading means writes a using history of the image carrier on the magnetic recording layer.

* * * * *